US005143033A

United States Patent [19]

Catterson et al.

[11] Patent Number: 5,143,033

[45] Date of Patent: Sep. 1, 1992

[54] INTERNAL COMBUSTION ENGINE HAVING AN INTEGRAL CYLINDER HEAD

[75] Inventors: Robert K. Catterson, Brookfield; Norbert M. Vogl, Milwaukee; Michael E. Kendziora, Hartland, all of Wis.

[73] Assignee: Briggs & Stratton Corp., Milwaukee, Wis.

[21] Appl. No.: 685,835

[22] Filed: Apr. 16, 1991

[51] Int. Cl.[5] ..... F02F 7/00

[52] U.S. Cl. ..... 123/195 R; 123/90.27; 123/196 R; 123/197.4; 123/376; 123/193.3

[58] Field of Search ..... 123/90.27, 90.31, 193 CH, 123/193 H, 195 R, 195 C, 197 AB, 376, 196 R; 74/579 E, 598

[56] References Cited

U.S. PATENT DOCUMENTS

| | | | |
|---|---|---|---|
| 1,191,246 | 7/1916 | Tillotson | 123/195 R |
| 1,339,497 | 5/1920 | Church | 123/376 |
| 2,324,373 | 7/1943 | Dusevoir | 74/598 |
| 2,346,207 | 4/1944 | Brown | 123/65 R |
| 2,700,964 | 2/1955 | Nallinger | 123/41.77 |
| 2,752,213 | 6/1956 | Swart et al. | 74/579 E |
| 3,691,914 | 9/1972 | Reisacher et al. | 123/193 CH |
| 3,983,852 | 10/1976 | Chatourel | 123/41.69 |
| 4,446,828 | 5/1984 | Bauder et al. | 123/195 R |
| 4,606,304 | 8/1986 | Kruger et al. | 123/193 CH |
| 4,691,546 | 2/1987 | Mettler | 74/598 |
| 4,984,539 | 1/1991 | Shinodo et al. | 123/90.27 |

OTHER PUBLICATIONS

Briggs & Stratton Illustrated Parts List Re: Engine Model Series 95720 to 95799 and 96720 to 96799, sold at least as early as 1986.

Briggs & Stratton Repair Instructions III, Published Dec. 1968.

Briggs & Stratton Series 92500 Engine Specifications, Published Aug. 1, 1971.

Briggs & Stratton Illustrated Parts List Model Series 92500-92599, Published Dec., 1981.

*Primary Examiner*—Noah P. Kamen

*Attorney, Agent, or Firm*—Andrus, Sceales, Starke & Sawall

[57] ABSTRACT

An internal combustion engine has an integral cylinder head, a one-piece connecting rod, and a crankshaft disposed at the interface between the first engine housing and the second engine housing. In an overhead cam shaft embodiment, the cam shaft drive means includes first and second gearsets of cross-helical gears. Also directly mounted to the cam drive shaft are the oil slinger, the centrifugally-responsive speed governor components, and the auxiliary power take-off shaft. This arrangement eliminates the need for additional shafts and subassemblies. In another embodiment, both the crankshaft and the cam shaft are disposed at the interface between the two engine housings to decrease manufacturing and assembly costs. The crankshaft and/or cam shaft bearings are formed integral with the engine housings to eliminate the need for separate bearing components.

15 Claims, 4 Drawing Sheets

INTERNAL COMBUSTION ENGINE HAVING AN INTEGRAL CYLINDER HEAD

BACKGROUND OF THE INVENTION

This invention relates to internal combustion engines, and more particularly to engines having an integral cylinder head.

Many types of internal combustion engine designs are known for use in lawnmowers, generators, snowblowers and the like as well as for motor vehicles. I n a typical prior art engine design, the engine housing is made of at least three distinct engine housings. Typically, there is a separate housing for the cylinder head that encloses the cylinder bore and the valves, and at least two additional housings for enclosing the other engine components. A cam shaft cover is also used to enclose the cam shaft in overhead cam (OHC) engines. The need for these engine housings requires additional die casting and assembly steps in the engine manufacturing process. These additional steps increase the cost of the engine.

Conventional engine designs require that the cam shaft be mounted in bosses affixed to the inside of the engine housing. These designs require additional or more complex assembly steps to insert the cam shaft into the engine housing. Separate cam shaft bearing components must also be manufactured and inserted about the cam shaft, resulting in additional manufacturing and assembly cost.

The crankshaft in conventional engine designs is typically disposed within opposite apertures machined in the engine housing side walls. These designs also increase the assembly time and require that separate crankshaft bearings be manufactured and placed around the crankshaft, further increasing the manufacturing and assembly cost.

The difficulty in assembling the conventional crankshaft and connecting rod components require that a two piece connecting rod be used to connect one end of the rod to the crankshaft throw. The two pieces of the connecting rod are typically bolted together by a pair of bolt assemblies. The need for a multi-piece connecting rod and the bolt assemblies also results in increased manufacturing and assembly costs.

In conventional overhead cam engines, the cam shaft is driven by a timing belt or chain assembly. Prior art timing belt drives have several disadvantages. First, the idler pulley must be adjusted so that the belt has the correct amount of tension. If the tension is too low, there is a risk that the belt will jump a tooth on the sprocket, causing improper engine timing. If the tension in the timing belt is too high, the belt and the bearings tend to wear prematurely.

A second disadvantage of prior art timing belts is that they typically require a belt guard or cover to keep debris off of the belt. A third disadvantage is that they typically require an oil seal on the cam shaft.

Chain assemblies used to drive cam shafts also have several disadvantages. First, chain drives, like belt drives, require an idler sprocket to adjust the tension. Second, chains require lubrication and are difficult to assemble. Third, chain drives require a rub rail on the outer side of the chain to keep the chain from slipping.

One obsolete method for driving the cam shaft used bevel gears. However, such bevel gears typically required very small center line and axial alignment tolerances, on the order of about ±0.001 inches. These small, critical tolerances require precision machining of the bevel gears at increased expense.

Typical small internal combustion engines require one or more additional shafts mounted to the inside of the engine housing to operate the oil slinger for engine lubrication and the engine governor for controlling engine speed. These additional shafts also require extra manufacturing and assembly steps, thereby further increasing the cost of the engine.

Therefore, it is desirable to reduce the number of engine housings, bearings, shafts and other component parts to decrease the manufacturing and assembly costs of an internal combustion engine.

SUMMARY OF THE INVENTION

An internal combustion engine is disclosed in which the number of distinct housings, shafts, bearings and other components is decreased to achieve substantial savings in manufacturing and assembly costs.

In its broadest form, the invention comprises an internal combustion engine having a first engine housing that includes a cylinder bore and an integral cylinder head, disposed near a first end of the housing. A first surface disposed near a second end of the housing is adapted to create an interface with a second surface on a second engine housing, with the crankshaft also being disposed near or at the interface between the two housings. This arrangement enables the crankshaft bearings that encircle and retain the crankshaft to be formed integrally with the first and second engine housings at the first and second surfaces respectively. This configuration also enables a one-piece connecting rod and a built-up or two-piece crankshaft to be used.

In one embodiment of the invention employing an overhead cam shaft, the drive means for driving the cam shaft includes two gearsets of cross-helical or non-enveloping worm gears. The drive or driven gears in each gearset may also be made from a plastics material containing nylon or phenol to further reduce costs.

Also in the overhead cam (OHC) embodiment, the OHC drive shaft or cross shaft is also used as both the shaft for the oil slinger and the speed governor, thereby eliminating the need for additional shafts to drive these components. The auxiliary power take off used for example to drive the wheels of a lawnmower is also directly connected to the cross shaft, thereby eliminating intervening gears and other components.

In a second embodiment of the invention, both the crankshaft and the cam shaft are disposed near or at the interface between the first engine housing and the second engine housing. This unique design also enables the cam shaft bearings to be integrally formed in the first surface and in the second surface of the first and second housings respectively, thereby eliminating the need for separate bearing components.

It is a feature and an advantage of the present invention to reduce the number of distinct components in an internal combustion engine to thereby decrease the cost of manufacturing and assembling the engine.

It is yet another feature and advantage of the present invention to reduce engine costs by integrating the cylinder head with one of the other engine housings.

It is yet another feature and advantage of the present invention to reduce engine costs by disposing the crankshaft and/or the cam shaft at the interface between the separate engine housings.

It is yet another feature and advantage of the present invention to reduce engine costs by forming the crankshaft and/or cam shaft bearings integral with the engine housings.

It is yet another feature and advantage of the present invention to reduce engine costs by using a one-piece connecting rod and a two-piece crankshaft.

It is yet another feature and advantage of the present invention to reduce OHC engine costs by the OHC drive shaft to drive both the oil slinger and the speed governor.

It is yet another feature and advantage of the present invention to reduce OHC engine costs by using OHC drive gears having less precise tolerances made from inexpensive plastic materials.

It is yet another feature and advantage of the present invention to reduce OHC engine costs by directly connecting the auxiliary power take off shaft to the OHC cross shaft without intervening gears or other linkage components.

These and other features of the present invention will be apparent to those skilled in the art from the following detailed description of the preferred embodiments and the attached drawings, in which:

DETAILED DESCRIPTION OF THE PREFERRED EMBODIMENTS

Figure 1:
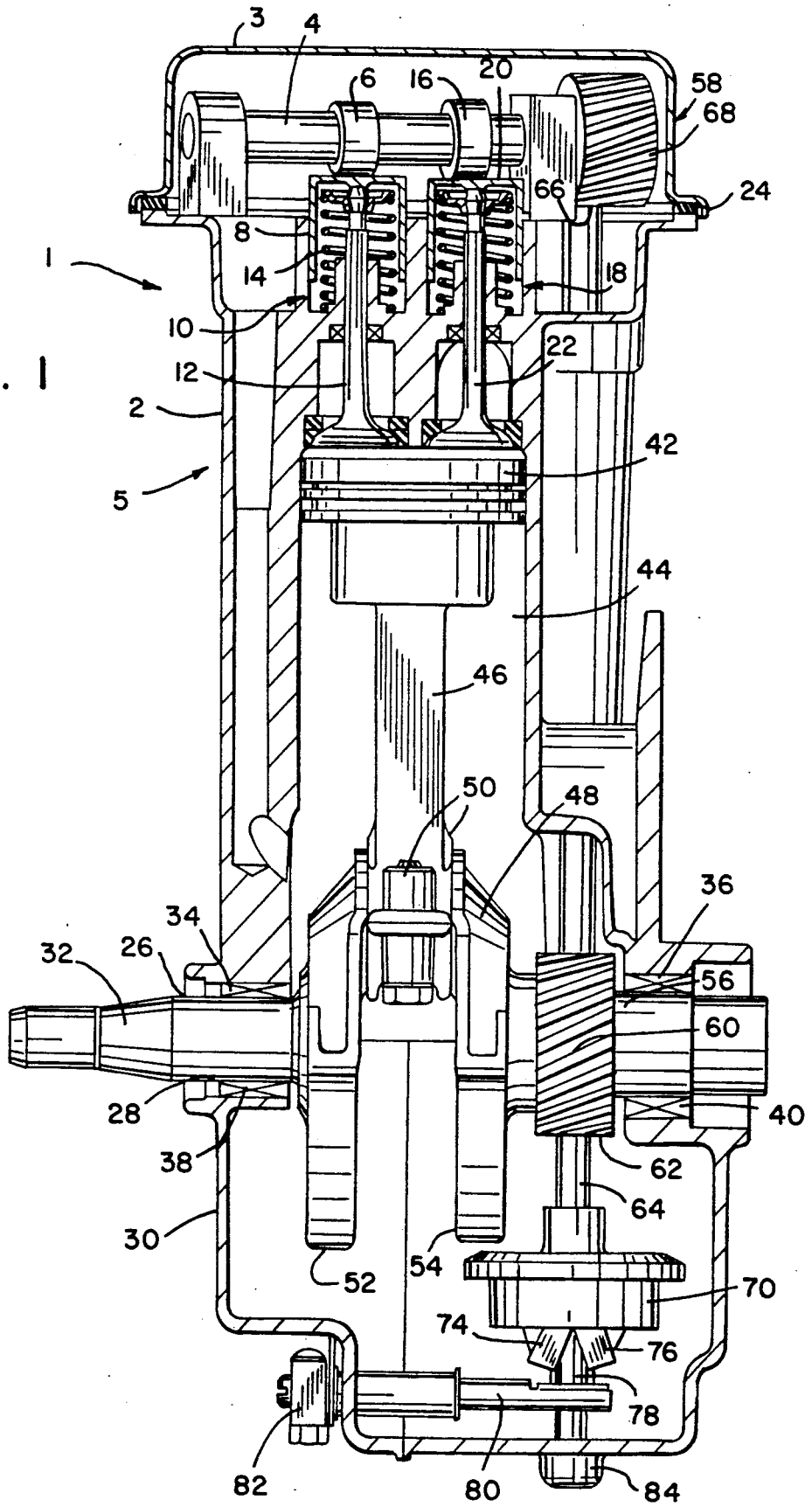
FIG. 1 is a side view of an overhead cam engine, shown in partial section.

In FIG. 1, engine 1 includes a first engine housing 2 and a cam shaft cover 3 that encloses overhead cam shaft 4. Formed integral with overhead cam shaft 4 is a cam 6 for operating the bucket tappet 8 of an exhaust valve 10, the valve consisting of a valve stem 12 and a spring 14. Similarly, cam 16 disposed on cam shaft 4 operates intake valve 18 by engaging intake bucket tappet 20. Intake valve 18 also includes a valve stem 22 and a spring 24.

First engine 2 includes a first surface 26 which forms an interface 86 (FIG. 2) with a second surface 28 of a second engine housing 30. Crankshaft 32 is disposed at the interface between first surface 26 and second surface 28. A first pair of spaced bearing cap sections 34 and 36 are also formed integral with first surface 26. Similarly, a second pair of spaced bearing sections 38 and 40 are formed integral with second surface 28 of the second engine housing. Bearing section 34 opposes bearing section 38, and bearing section 36 opposes bearing section 40. Bearings 34, 36, 38 and 40 are formed integral with their respective engine housings to reduce cost, and are disposed near interface 86.

A piston 42 disposed within cylinder bore 44 is connected to crankshaft 32 by a two-piece connecting rod 46. One end of connecting rod 46 is connected to piston 42, and the opposite end of rod 46 is connected to crankshaft 32 at crankshaft throw 48. The two pieces of the connecting rod are held together by a pair of bolt assemblies 50. The reciprocating and vibrational forces of the piston are opposed by a pair of counterweights 52 and 54 connected to the crankshaft.

Overhead cam shaft 4 is rotatably driven by a drive means consisting of a first gearset 56 and a second gearset 58. Gearsets 56 and 58 are preferably comprised of pairs of cross-helical gears because such gears do not require precise tolerances. The cross-helical gears only require a center distance tolerance of about ±0.004 inches. The axial alignment tolerance for the cross-helical gears in the present invention is in the range of between about ±0.060 to ±0.070 inches. However, bevel or other types of gears may also be used for gears in gearsets 56 and 58.

First gearset 56 includes a crankshaft drive gear 60 and a driven gear 62 interconnected with the drive or cross shaft 64. Second gearset 58 includes a cross shaft drive gear 66 and a cam shaft driven gear 68. Rotation of crankshaft 32 causes the drive means to rotate cam shaft 4 at twice the speed of the crankshaft to operate the intake and exhaust valves.

Instead of being mounted on a separate shaft to the inside of the engine housing, oil slinger 70 is directly mounted onto cross shaft 64 and rotatable therewith. Oil slinger 70 distributes or splashes oil to lubricate the moving components of the engine.

Several components of the engine speed governor are also directly connected to cross shaft 64. Specifically, a pair of centrifugally-responsive flyweights 74 and 76 are disposed about cross shaft 64 and adjacent to oil slinger 70. The rotation of cross shaft 64 causes flyweights 74 and 76 to move in a radial direction away from cross shaft 64 at higher engine speeds, thereby causing a governor spool 78 to engage a governor actuating arm 80. The movement of arm 80 moves a governor lower arm 82 interconnected therewith. In turn, the movement of lever arm 82 moves the throttle plate of the engine carburetor to adjust engine speed.

Also directly connected to cross shaft 64 is an auxiliary power take off shaft 84, which may be used to operate the wheels of a lawnmower or other accessories. The direct connection of shaft 84 to cross shaft 64 eliminates the need for any intervening gearsets or other mechanical linkages.

Figure 2:
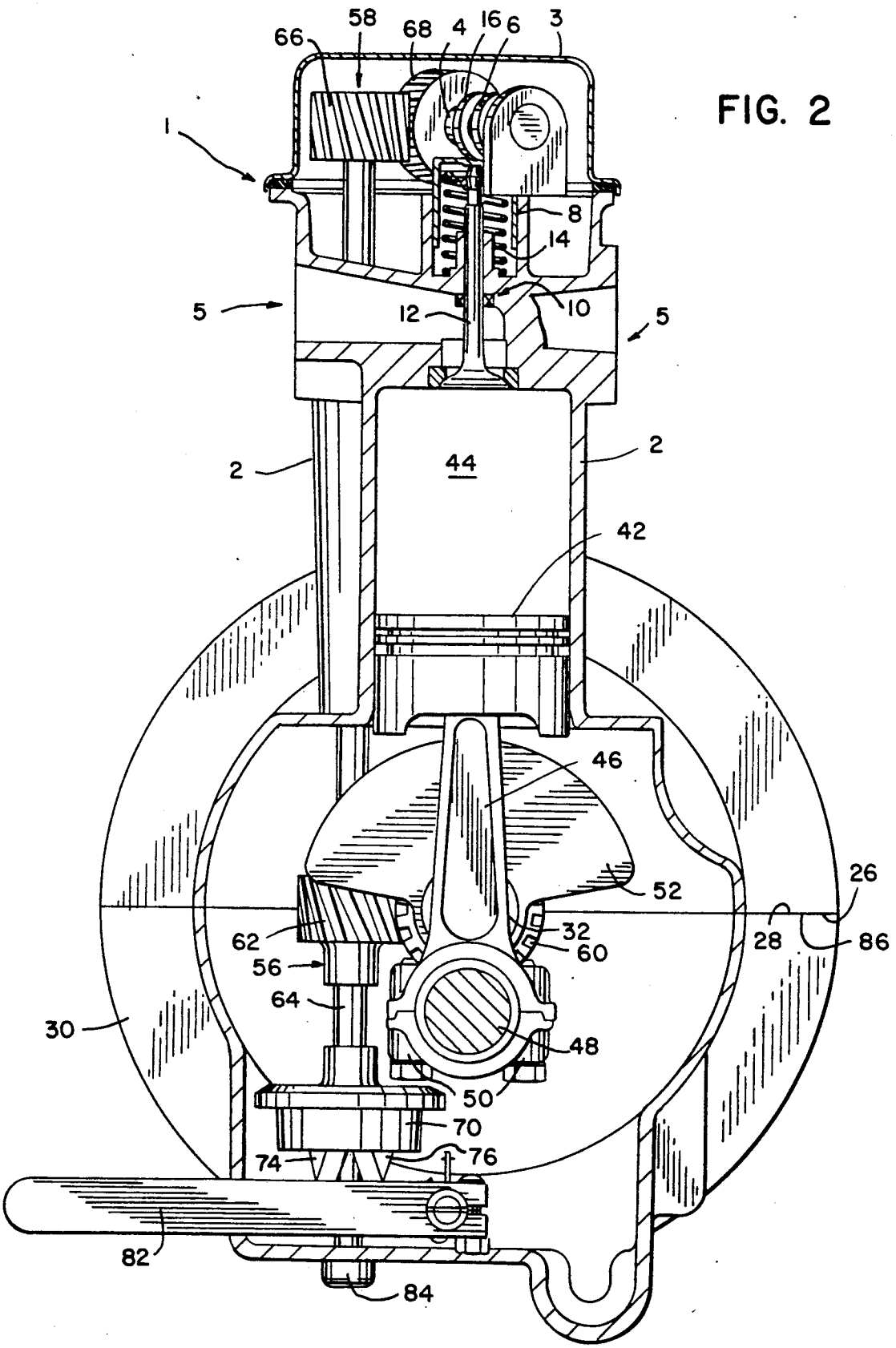
FIG. 2 is a partial sectional side view of the OHC engine of FIG. 1, the engine having been rotated 90° clockwise about its longitudinal axis.

FIG. 2 is another side view of the engine of FIG. 1 shown in partial section. In FIG. 2 as in all of the Figures, components having corresponding functions have been given the same numerical designations.

FIG. 2 more clearly depicts the interface 86 between first surface 26 and second surface 28. It is clear from FIG. 2 that crankshaft 32 lies at the interface 86. This positioning of the crankshaft decreases the cost and time required to assemble the engine since crankshaft 32 may be simply laid onto either first surface 26 or second surface 28 without fitting the crankshaft through apertures in the side wall of the engine housing, as in conventional engine designs.

FIG. 2 also more clearly depicts the gears in first gearset 56 and in second gearset 58. Specifically, FIG. 2 depicts crankshaft drive gear 60 engaging cross shaft driven gear 62. Similarly, FIG. 2 depicts cross shaft drive gear 66 engaging cam shaft driven 68.

As depicted in both FIGS. 1 and 2, cylinder head 5 is formed integral with first engine housing 2 to decrease manufacturing and assembly cost. FIG. 2 also depicts a two-piece connecting rod 46 which is held together by bolt assemblies 50 as described above in connection with FIG. 1.

Figure 3:
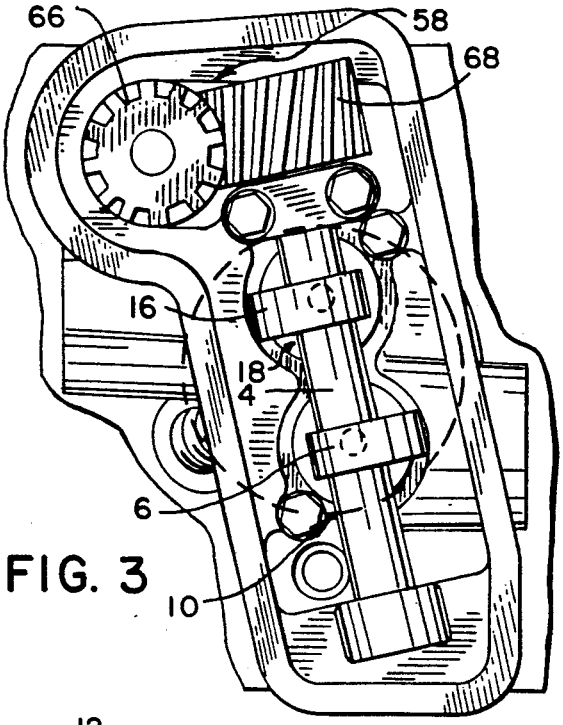
FIG. 3 is a top view of the engine depicted in FIGS. 1 and 2 with the cam shaft cover removed, depicting the overhead cam shaft.

FIG. 3 is a top view of the engine depicted in FIGS. 1 and 2. FIG. 3 more clearly depicts the engagement of gears 66 and 68 in second gearset 58. FIG. 3 also depicts the spatial relationship between cams 6 and 16 and their respective valve assemblies 10 and 18.

Figure 4:
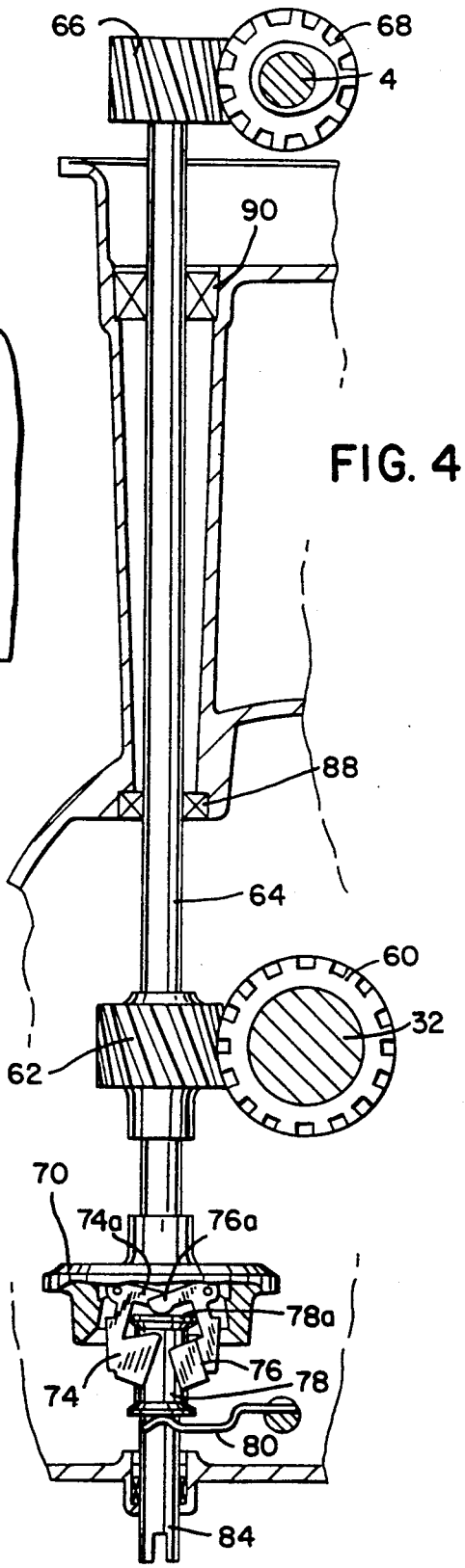
FIG. 4 is a partial sectional side view of the drive means for driving the overhead cam shaft and of the oil slinger and governor assemblies of the engine depicted in FIGS 1-3.

FIG. 4 is a partial cross sectional side view which more clearly depicts the drive means used for driving the overhead cam shaft. As shown in FIG. 4, cross shaft 64 is retained by bearings 88 and 90, which are preferably integral with the first engine housing.

FIG. 4 also more clearly depicts the configuration of centrifugal flyweights 74 and 76 and their relationship to governor spool 78. As cross shaft 64 rotates, flyweights 74 and 76 move in a radially outward direction from the cross shaft, causing their respective dog legs 74*a* and 76*a* to engage a flange 78*a* on spool 78. This engagement causes spool 78 to move in an axial direction away from oil slinger 70 to engage governor actuating arm 80. The movement of actuating arm 80 causes the engine speed to change via governor lever 82 as discussed above in connection with FIG. 1.

FIG. 4 also depicts auxiliary power take off (PTO) shaft 84 which is directly connected and preferably an integral part of cross shaft 64. Auxiliary PTO shaft 84 is used to drive the wheels or other accessories as discussed above.

Figure 5:
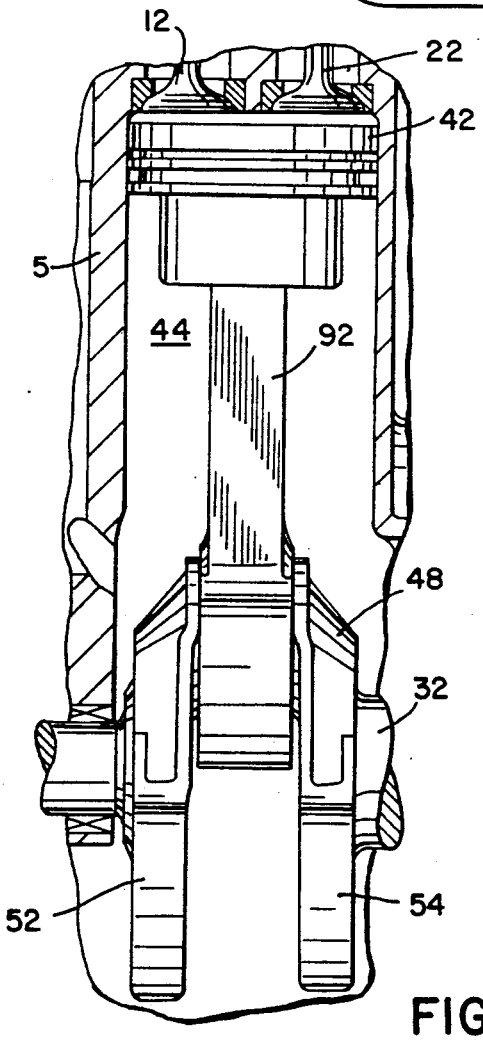
FIG. 5 is a partial sectional side view of the first embodiment depicted in FIGS. 1-4, depicting a one-piece connecting rod with the piston at top dead center.
Figure 6:
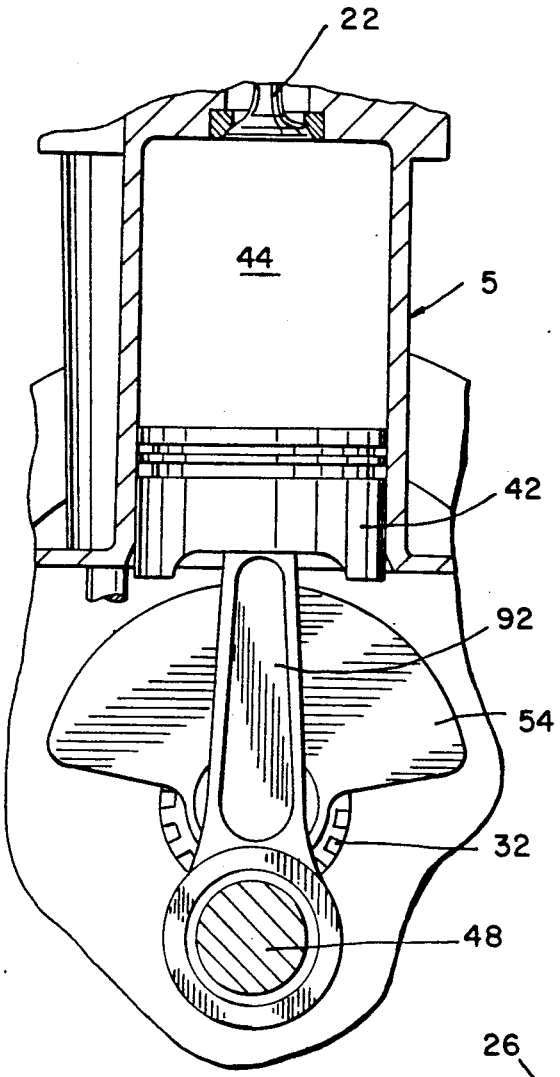
FIG. 6 is a partial sectional side view similar to FIG. 5 but rotated 90° clockwise about the engine's longitudinal axis, depicting the piston at bottom dead center.

FIGS. 5 and 6 depict the piston, connecting rod and crankshaft assembly in which a one-piece connecting rod 92 is used instead of the two-piece connecting rod 46 depicted and described above in connection with FIGS. 1 and 2. The use of a one-piece connecting rod 92 may require that crankshaft 32 be made of several pieces to enable the engine to be easily assembled. The use of a one-piece connecting rod may have certain cost advantages over the two-piece connecting rod discussed above.

Figure 7:
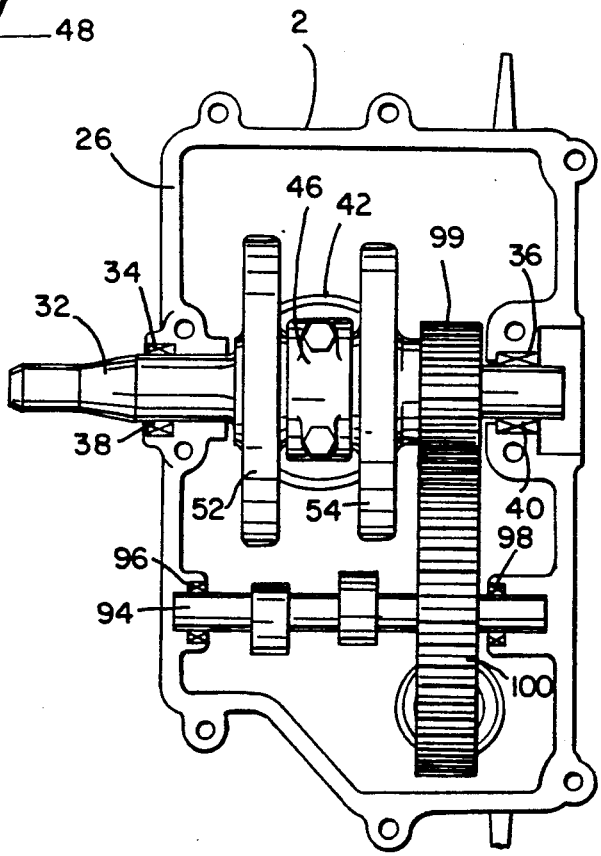
FIG. 7 is a top view of an engine housing according to the second embodiment of the present invention, depicting both the crankshaft and the cam shaft being disposed at the interface between the two engine housings.

FIG. 7 depicts a second embodiment of the present invention in which both crankshaft 32 and cam shaft 94 are disposed at the interface between first surface 26 (FIGS. 1 and 2) and second surface 28. In this second embodiment, cam shaft 94 is encircled by two sets of spaced cam shaft bearing cap sections 96 and 98. Bearings 96 and 98, including their counterpart spaced sections on the second engine housing, are formed integral with their respective engine housings to eliminate the need for separate bearing components.

Cam shaft 94 rotates in timed relation to crankshaft 32 by way of a timing gear 99, interconnected with the crankshaft that engages a cam gear 100 interconnected with cam shaft 94. Although FIG. 7 depicts a two-piece connecting rod 46, a one-piece connecting rod like rod 92 discussed above may also be used. If a one-piece connecting rod is used, it may be necessary to use a multi-piece crankshaft.

Although particular embodiments of the present invention have been shown and described, other alternate embodiments will be apparent to those skilled in the art and are within the intended scope of the present invention. Thus, the present invention is to be limited only by the following claims.

We claim:

1. An internal combustion engine, comprising:
a first engine housing, including:
at least one cylinder bore;
a first surface disposed near an end of said first engine housing;
a second engine housing including a second surface adapted to create an interface with said first surface;
a cam shaft disposed near said interface between said first surface and said second surface;
a crankshaft disposed near said interface between said first surface and said second surface;
a piston disposed within said cylinder bore; and
a connecting rod having one end interconnected with said piston and an opposite end interconnected with said crankshaft.

2. The internal combustion engine of claim 1, wherein said connecting rod is comprised of a single piece.

3. The internal combustion engine of claim 2, wherein said crankshaft is comprised of more than one piece.

4. The internal combustion engine of claim 1, further comprising:
a crankshaft bearing means disposed near said interface for engaging said crankshaft; and
a cam shaft bearing means disposed near said interface for engaging said camshaft.

5. The internal combustion engine of claim 4, wherein said crankshaft bearing means includes a first bearing section integral with said first surface and an opposite second bearing section integral with said second surface;
and wherein
said camshaft bearing means includes a third bearing section integral with said first surface and an opposite second bearing section integral with said second surface.

6. The internal combustion engine of claim 1, wherein said first engine housing further comprises:
a cylinder head integral with said cylinder bore.

7. An internal combustion engine, comprising:
a first engine housing, including
at least one cylinder bore;
a cylinder head integral with said cylinder bore and disposed near a first end of said first engine housing;
a first surface disposed near a second end of said first engine housing;
a second engine housing including a second surface adapted to create an interface with said first surface;
a crankshaft disposed near said interface;
a piston disposed in said cylinder bore;
a one-piece connecting rod having one end interconnected with said piston and an opposite end interconnected with said crankshaft; and
a cam shaft disposed near said interface.

8. The internal combustion engine of claim 7, further comprising:
a first bearing means integral with said first surface for engaging said cam shaft; and a second bearing means integral with said second surface for engaging said cam shaft, said cam shaft being disposed between said first bearing means and said second bearing means.

9. The internal combustion engine of claim 8, wherein said first bearing means comprises a first pair of spaced bearing sections and wherein said second bearing means comprises a second pair of spaced bearing sections.

10. An internal combustion engine, comprising:

a first engine housing, including at least one cylinder bore;

a cylinder head integral with said cylinder bore and disposed near a first end of said first engine housing;

a first surface disposed near a second end of said first engine housing;

a second engine housing including a second surface adapted to create an interface with said first surface;

a crankshaft disposed near said interface;

a piston disposed in said cylinder bore;

a one-piece connecting rod having one end interconnected with said piston and an opposite end interconnected with said crankshaft;

an overhead cam shaft disposed near said cylinder head;

drive means for rotating said cam shaft in response to rotation of said crankshaft, said drive means further comprising:

a cross shaft;

a first gearset including a crankshaft drive gear interconnected with said crankshaft;

a cross shaft driven gear interconnected with said cross shaft that engages said crankshaft drive gear;

a second gearset including a cross shaft drive gear interconnected with said cross shaft;

a cam shaft driven gear interconnected with said cam shaft that engages said cross shaft drive gear; and an oil slinger interconnected with said cross shaft.

11. An internal combustion engine, comprising:

a first engine housing, including at least one cylinder bore;

a cylinder head integral with said cylinder bore and disposed near a first end of said first engine housing;

a first surface disposed near a second end of said first engine housing;

a second engine housing including a second surface adapted to create an interface with said first surface;

a crankshaft disposed near said interface;

a piston disposed in said cylinder bore;

a one-piece connecting rod having one end interconnected with said piston and an opposite end interconnected with said crankshaft;

an overhead cam shaft disposed near said cylinder head;

drive means for rotating said cam shaft in response to rotation of said crankshaft, said drive means further comprising:

a cross shaft;

a first gearset including a crankshaft drive gear interconnected with said crankshaft;

a cross shaft driven gear interconnected with said cross shaft that engages said crankshaft drive gear;

a second gearset including a cross shaft drive gear interconnected with said cross shaft; and a cam shaft driven gear interconnected with said cam shaft that engages said cross shaft drive gear; and a centrifugally responsive governor means, interconnected with said cross shaft, for controlling the speed of the engine.

12. The internal combustion engine of claim 11, wherein said governor means includes:

at least one flyweight; and a spool movable in response to movement of said flyweight.

13. An internal combustion engine, comprising:

a first engine housing, including:

at least one cylinder bore;

a cylinder head integral with said cylinder bore and disposed near a first end of said first engine housing;

a first surface disposed near a second end of said first engine housing;

a second engine housing including a second surface adapted to create an interface with said first surface;

a crankshaft disposed near said interface;

an overhead cam shaft disposed near said cylinder head;

drive means for rotating said cam shaft in response to rotation of said crankshaft, wherein said drive means further comprises:

a cross shaft;

a first gearset including a crankshaft drive gear interconnected with said crankshaft;

a cross shaft driven gear interconnected with said cross shaft that engages said crankshaft drive gear;

a second gearset including a cross shaft drive gear interconnected with said cross shaft;

a cam shaft driven gear interconnected with said cam shaft that engages said cross shaft drive gear; and an oil slinger interconnected with said cross shaft.

14. An internal combustion engine, comprising:

a first engine housing, including:

at least one cylinder bore;

a cylinder head integral with said cylinder bore and disposed near a first end of said first engine housing;

a first surface disposed near a second end of said first engine housing;

a second engine housing including a second surface adapted to create an interface with said first surface;

a crankshaft disposed near said interface;

an overhead cam shaft disposed near said cylinder head;

drive means for rotating said cam shaft in response to rotation of said crankshaft, wherein said drive means further comprises:

a cross shaft;

a first gearset including a crankshaft drive gear interconnected with said crankshaft;

a cross shaft driven gear interconnected with said cross shaft that engages said crankshaft drive gear;

a second gearset including a cross shaft drive gear interconnected with said cross shaft;

a cam shaft driven gear interconnected with said cam shaft that engages said cross shaft drive gear; and a centrifugally responsive governor means, interconnected with said cross shaft, for controlling the speed of said engine.

15. The internal combustion engine of claim 14, wherein said governor means includes:

at least one flyweight; and a spool movable in response to movement of said flyweight.

* * * * *